US009866973B2

(12) United States Patent
Park et al.

(10) Patent No.: US 9,866,973 B2
(45) Date of Patent: Jan. 9, 2018

(54) METHOD AND APPARATUS FOR BATTERY BALANCING OF HEARING AID IN ELECTRONIC DEVICE

(71) Applicant: Samsung Electronics Co., Ltd., Suwon-si, Gyeonggi-do (KR)

(72) Inventors: Jung-Keun Park, Seoul (KR); Heon-Chol Kim, Seoul (KR); Seong-Hun Jeong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/595,732

(22) Filed: Jan. 13, 2015

(65) Prior Publication Data

US 2015/0201284 A1 Jul. 16, 2015

(30) Foreign Application Priority Data

Jan. 15, 2014 (KR) ..... 10-2014-0004992

(51) Int. Cl.
*H04R 25/00* (2006.01)

(52) U.S. Cl.
CPC ..... *H04R 25/30* (2013.01); *H04R 25/552* (2013.01); *H04R 2225/61* (2013.01); *H04R 2460/03* (2013.01)

(58) Field of Classification Search
CPC ..... H04R 25/602; H04R 2225/31; H04R 2225/61
USPC ..... 381/312, 314, 315, 320, 321, 323; 455/41.2, 66.1, 67.11, 569.1
See application file for complete search history.

(56) References Cited

U.S. PATENT DOCUMENTS

| | | | | |
|---|---|---|---|---|
| 6,035,050 | A * | 3/2000 | Weinfurtner | H04R 25/507 381/313 |
| 8,050,439 | B2 | 11/2011 | Inoshita et al. | |
| 8,265,314 | B2 * | 9/2012 | Schumaier | H04R 25/70 381/312 |
| 8,284,968 | B2 * | 10/2012 | Schumaier | H04R 25/70 312/314 |
| 9,319,806 | B2 * | 4/2016 | Ku | H04R 25/552 |
| 2004/0190738 | A1 * | 9/2004 | Meier | H04R 25/505 381/312 |
| 2009/0197532 | A1 * | 8/2009 | Wyper | H04M 1/6066 455/41.2 |
| 2010/0128907 | A1 * | 5/2010 | Dijkstra | H04R 25/407 381/315 |
| 2011/0158441 | A1 * | 6/2011 | Batra | H04R 1/1091 381/311 |
| 2014/0169570 | A1 * | 6/2014 | Kalluri | H04R 25/552 381/23.1 |

(Continued)

FOREIGN PATENT DOCUMENTS

| | | | |
|---|---|---|---|
| JP | 4530109 B1 | 8/2010 | |
| WO | WO 2015018456 A1 * | 2/2015 | H04R 25/305 |

*Primary Examiner* — Davetta W Goins
*Assistant Examiner* — Phylesha Dabney
(74) *Attorney, Agent, or Firm* — Jefferson IP Law, LLP

(57) ABSTRACT

A method for maintaining battery balancing of a hearing aid in an electronic device is provided. The method includes establishing a connection with a first hearing aid, determining whether the connection with the first hearing aid is maintained for more than a specific period, and if the connection with the first hearing aid is maintained for more than the specific period, establishing a connection with a second hearing aid.

12 Claims, 5 Drawing Sheets

(56) References Cited

U.S. PATENT DOCUMENTS

2014/0307901 A1* 10/2014 Ku ..... H04R 25/552
381/315
2017/0105076 A1* 4/2017 Gehring ..... H04R 25/552

* cited by examiner

METHOD AND APPARATUS FOR BATTERY BALANCING OF HEARING AID IN ELECTRONIC DEVICE

CROSS-REFERENCE TO RELATED APPLICATION(S)

This application claims the benefit under 35 U.S.C. §119 (a) of a Korean patent application filed on Jan. 15, 2014 in the Korean Intellectual Property Office and assigned Serial number 10-2014-0004992, the entire disclosure of which is hereby incorporated by reference.

TECHNICAL FIELD

The present disclosure relates to a method and apparatus for battery balancing of a hearing aid in an electronic device.

BACKGROUND

In general, a hearing aid is attached to an ear when in use. In an initial stage, an audiologist can minutely adjust fitting information (e.g., a sound control, a frequency amplification condition, etc.) to an audiogram of a corresponding user. However, the user encounters various sound environments in daily life. In this case, if the fitting information is not correctly changed according to the environment, the user experiences an inconvenience. However, whenever the user's environment is changed, the hearing aid is detached from the ear to adjust the fitting information and is then attached again, which is a very cumbersome task. Further, since an ordinary user cannot directly adjust the fitting information, aid of the audiologist is necessary.

In addition, since the hearing aid operates in a state of being attached to the ear of the user, it is inconvenient and cumbersome for the user to correctly recognize an operational situation of the hearing aid in daily life. As a representative example, a case may frequently occur in which the user determines that the hearing aid is broken even if a normal operation is impossible simply due to a power shortage. This may be because the user fails to correctly recognize the power shortage situation.

In order to reduce such an inconvenience, an electronic device may control the hearing aid according to a surrounding situation of the hearing aid, or may display a current state (e.g., an operation, a surrounding environment, etc.) of the hearing aid.

The above information is presented as background information only to assist with an understanding of the present disclosure. No determination has been made, and no assertion is made, as to whether any of the above might be applicable as prior art with regard to the present disclosure.

SUMMARY

At present, when a binaural hearing aid is used, a battery off time is different in hearing aids of both sides, which causes a significant inconvenience of users. Further, the hearing aid may be used unreasonably, for example, in such a manner that, if a battery of one side is discharged, a battery of the other side is also replaced together.

In general, remaining battery capacities of the hearing sides of both sides are compared, and the hearing aid of a side having a low battery capacity is allowed to operate in a low power consumption mode. In the low power consumption mode, an operation may be performed in which a function such as a howling suppression, a noise suppression, and the like is suspended when a surrounding environment is below 40 dB SPL, and an amplification amount is decreased when it is above 80 dB SPL.

In case of a Zinc-Air battery and Ni-MH battery typically used in the hearing aid, there are many difficulties in a correct measurement of a remaining battery capacity over time since a battery voltage is constantly maintained and is rapidly decreased at an end stage of a battery discharge.

In addition, even if a function at a specific situation is suspended or an amplification amount is decreased, there are also many difficulties for equally adjusting a battery discharge time of the hearing aids of the both sides by decreasing a difference of a consumption current amount caused by a wireless communication.

Aspects of the present disclosure are to address at least the above-mentioned problems and/or disadvantages and to provide at least the advantages described below. Accordingly, an aspect of the present disclosure is to provide a method and apparatus for battery balancing of a hearing aid in an electronic device. A battery discharge time of hearing aids of both sides is equally adjusted by decreasing a consumed current difference of the hearing aids of the both sides caused by a wireless communication between the hearing aid and a third electronic device, thereby increasing an efficiency of a battery usage.

In accordance with an aspect of the present disclosure, a method for maintaining battery balancing of a hearing aid in an electronic device is provided. The method includes establishing a connection with a first hearing aid, determining whether the connection with the first hearing aid is maintained for more than a specific period, and if the connection with the first hearing aid is maintained for more than the specific period, establishing a connection with a second hearing aid.

In accordance with an aspect of the present disclosure, the method may further include terminating the connection with the first hearing aid, wherein the termination of the connection with the first hearing aid is performed before or after the establishing of the connection with the second hearing aid.

In accordance with an aspect of the present disclosure, the method may further include, before the determining of whether the connection with the first hearing aid is maintained for more than the specific period, determining whether the remaining battery capacity of the first hearing aid is above a threshold.

In accordance with an aspect of the present disclosure, the method may further include, if the remaining battery capacity of the first hearing aid is below the threshold, establishing the connection with the second hearing aid, wherein the determining of whether the connection with the first hearing aid is maintained for more than a specific period is performed if the remaining battery capacity of the first hearing aid is above the threshold.

In accordance with an aspect of the present disclosure, the method may further include determining whether the connection with the second hearing aid is maintained for more than the specific period, and if the connection with the second hearing aid is maintained for more than the specific period, establishing a reconnection with the first hearing aid.

In accordance with an aspect of the present disclosure, the method may further include comprising terminating the reconnection with the first hearing aid, wherein the termination of the reconnection with the first hearing aid is performed before or after establishing the connection with the second hearing aid.

In accordance with an aspect of the present disclosure, the method may further include, before the determining of whether the connection with the second hearing aid is maintained for more than the specific period, determining whether the remaining battery capacity of the second hearing aid is above the threshold.

In accordance with an aspect of the present disclosure, the method may further include, if the remaining battery capacity of the second hearing aid is below the threshold, establishing the reconnection with the first hearing aid, wherein the determining of whether the connection with the second hearing aid is maintained for more than the specific period is performed if the remaining battery capacity of the second hearing aid is above the threshold.

In accordance with another aspect of the present disclosure, a method for maintaining battery balancing of a hearing aid is provided is provided. The method includes establishing a connection with an electronic device, and if the connection with the electronic device is maintained for more than a specific period, terminating the connection with the electronic device.

In accordance with another aspect of the present disclosure, the method may further include determining whether the remaining battery capacity of the hearing aid is above a threshold, and if the remaining battery capacity of the hearing aid is below the threshold, communicating information regarding the remaining battery capacity of the hearing aid to the electronic device.

In accordance with another aspect of the present disclosure, an electronic device is provided. The electronic device includes a communication interface configured to communicate with at least one of a first hearing aid and a second hearing aid, and a battery balancing module configured to control the communication interface to establish a connection with a first hearing aid, to determine whether the connection with the first hearing aid is maintained for more than a specific period, and if the connection with the first hearing aid is maintained for more than the specific period, to control the communication interface to establish a connection with the second hearing aid.

In accordance with another aspect of the present disclosure, the battery balancing module controls the communication interface to terminate the connection with the first hearing aid before or after the battery balancing module controls the communication interface to establish the connection with the second hearing aid.

In accordance with another aspect of the present disclosure, before the battery balancing module determines whether the connection with the first hearing aid is maintained for more than the specific period, the battery balancing module may determine whether the remaining battery capacity of the first hearing aid is above a threshold.

In accordance with another aspect of the present disclosure, the battery balancing module may determine whether the connection with the first hearing aid is maintained for more than the specific period if the remaining battery capacity of the first hearing aid is above the threshold, and the battery balancing module may control the communication interface to establish the connection with the second hearing aid via the communication interface if the remaining battery capacity of the first hearing aid is below the threshold.

In accordance with another aspect of the present disclosure, the battery balancing module may determine whether the connection with the second hearing aid is maintained for more than the specific period, and if the connection with the second hearing aid is maintained for more than the specific period, the battery balancing module may control the communication interface to establish a reconnection with the first hearing aid.

In accordance with another aspect of the present disclosure, the battery balancing module may control the communication interface to terminate the reconnection with the first hearing aid before or after establishing the connection with the second hearing aid.

In accordance with another aspect of the present disclosure, the battery balancing module may determine whether the connection with the second hearing aid is maintained for more than the specific period, and may determine whether the remaining battery capacity of the second hearing aid is above the threshold.

In accordance with another aspect of the present disclosure, the battery balancing module may determine whether the connection with the second hearing aid is maintained for more than the specific period if the remaining battery capacity of the second hearing aid is above the threshold, and the battery balancing module may control the communication interface to establish the reconnection with the first hearing aid if the remaining battery capacity of the second hearing aid is below the threshold.

In accordance with another aspect of the present disclosure, an apparatus for maintaining battery balancing of a hearing aid is provided. The apparatus includes a wireless unit configured to communicate with an electronic device, and a controller configured to control the wireless unit to establish a connection with an electronic device, and to terminate the connection with the electronic device if the connection with the electronic device is maintained for more than a specific period.

In accordance with another aspect of the present disclosure, the controller may determine whether the remaining battery capacity of the hearing aid is above a threshold, and if the remaining battery capacity of the hearing aid is below the threshold, may communicate information regarding the remaining battery capacity of the hearing aid to the electronic device.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, a method and apparatus for battery balancing of a binaural hearing aid are described according to various embodiments of the present disclosure.

Figure 1A:
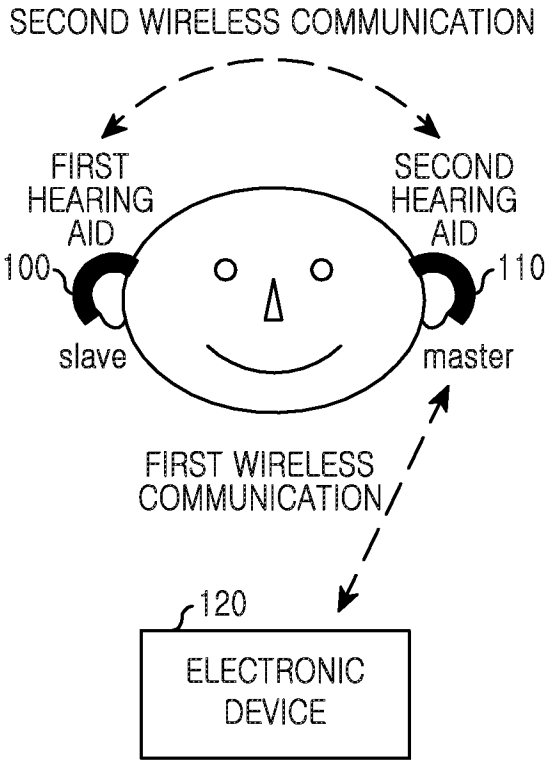
FIGS. 1A and 1B illustrate an example of adjusting battery balancing of a binaural hearing aid by periodically replacing a connection between an electronic device and the binaural hearing aid according to various embodiments of the present disclosure.
Figure 1B:
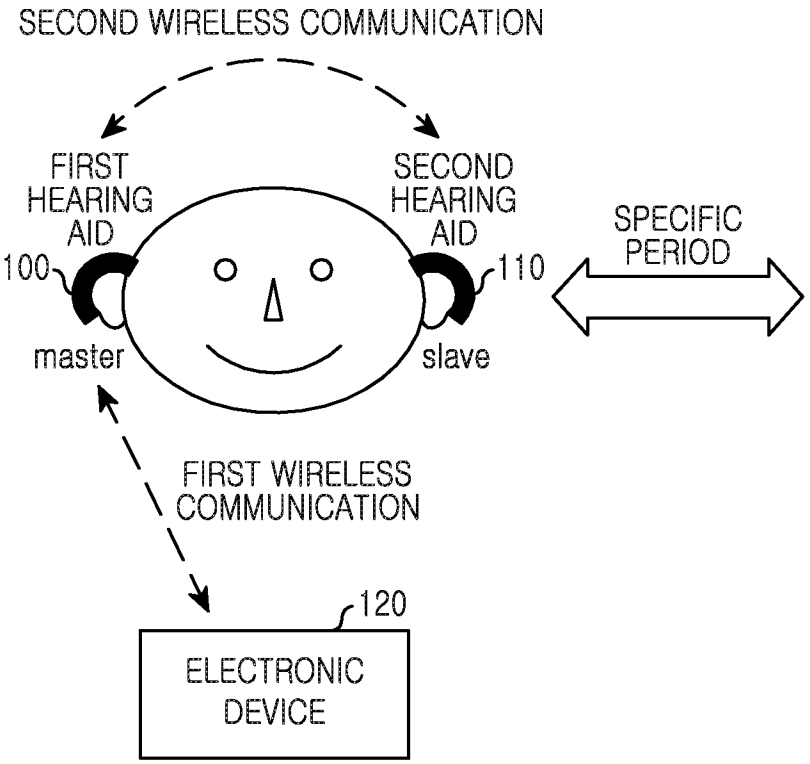

FIGS. 1A and 1B illustrate an example of adjusting battery balancing of a binaural hearing aid by periodically replacing a connection between an electronic device and the binaural hearing aid according to various embodiments of the present disclosure.

Referring to FIGS. 1A and 1B, two types of wireless communication mechanisms may be used in the binaural hearing aid (e.g., a first hearing aid and a second hearing aid). For example, a first wireless communication mechanism is a wireless communication mechanism between a first hearing aid 100 or a second hearing aid 110 and an electronic device 120, and a second wireless communication mechanism is a wireless communication mechanism between the first hearing aid 100 and the second hearing aid 110.

When connected with the electronic device 120 such as a smart phone or the like through the first wireless communication, the connected first hearing aid 100 may be a master device, and the second hearing aid 110 not connected with the electronic device 120 may be a slave device. In various embodiments of the present disclosure, a channel state or a signal strength may be a criterion of determining to which hearing aid a connection will be attempted between the two hearing aids.

The second wireless communication mechanisms may be communication mechanisms for a connection between the master device and the slave device, that is, between the first hearing aid 100 and the second hearing aid 110. For example, through the second wireless communication mechanism, data such as a parameter for the binaural hearing aid, an audio streaming, or the like may be transmitted to the master device and the slave device.

The data such as the parameter for the binaural algorithm, the audio streaming, or the like is transmitted.

In various embodiments of the present disclosure, the first communication mechanism may be in Bluetooth Low Energy (BLE), and the second communication mechanism may be Near-Field Magnetic Induction (NFMI). However, in various embodiments of the present disclosure, the first communication mechanism and the second communication mechanisms are not limited to the BLE communication and the NFMI communication, and may be determined by combining other various near distance communication mechanisms (e.g., Wireless Fidelity (Wi-Fi), Near Field Communication (NFC), ZigBee, Ultra Wideband (UWB), Infrared Data Association (IrDA) communication, etc.).

When a specific time elapses after a connection between the electronic device 120 and the first hearing aid 100 is achieved, the electronic device 120 may be disconnected from the first hearing aid 100, and may attempt to connect with the second hearing aid 110 through the first wireless communication. In this case, if the connection is successful, the second hearing aid 110 is changed from the slave device to the master device, and the first hearing aid 100 may be changed from the master device to the slave device.

According to various embodiments of the present disclosure, the electronic device 120 may attempt to connect with the second hearing aid 110 through the first wireless communication, and thereafter may be disconnected from the first hearing aid 100.

For example, before the electronic device 120 attempts to connect with the second hearing aid 110, the first hearing aid 100 may activate the first wireless communication of the second hearing aid 110, and may deactivate its first wireless communication, so that the connection between the binaural hearing aid and the electronic device 120 is not disconnected.

An electronic device according to the present disclosure may be a device including a communication function. For example, the electronic device may include at least one of a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a Moving Picture Experts Group (MPEG)-1 Audio Layer 3 (MP3) player, a mobile medical device, a camera, and a wearable device (e.g., a Head-Mounted-Device (HMD) such as electronic glasses, electronic clothes, an electronic bracelet, an electronic necklace, an electronic appcessory, an electronic tattoo, or a smart watch).

According to various embodiments of the present disclosure, the electronic device may be a smart home appliance having a communication function. For example, the smart home appliance may include at least one of a TeleVision (TV), a Digital Video Disk (DVD) player, an audio, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to various embodiments of the present disclosure, the electronic device may include at least one of various medical devices (e.g., Magnetic Resonance Angiography (MRA), Magnetic Resonance Imaging (MRI), Computed Tomography (CT), imaging equipment, ultrasonic instrument, etc.), a navigation device, a Global Positioning System (GPS) receiver, an Event Data Recorder (EDR), a Flight Data Recorder (FDR), a car infotainment device, an electronic equipment for ship (e.g., a vessel navigation device, a gyro compass, etc.), avionics, a security device, and an industrial or domestic robot.

According to various embodiments of the present disclosure, the electronic device may include at least one of a furniture or a part of building/constructions including a communication function, an electronic board, an electronic signature input device, a projector, and various measurement machines (e.g., water supply, electricity, gas, propagation measurement machine, etc.). The electronic device according to the present disclosure may be one or more combinations of the aforementioned various devices. In addition, it is apparent to those ordinarily skilled in the art that the electronic device according to the present disclosure is not limited to the aforementioned devices.

Hereinafter, an electronic device according to various embodiments of the present disclosure will be described with reference to the accompanying drawings. The term 'user' used in the various embodiments of the present disclosure may refer to a person who uses the electronic device or a device which uses the electronic device (e.g., an Artificial Intelligence (AI) electronic device).

Figure 2:
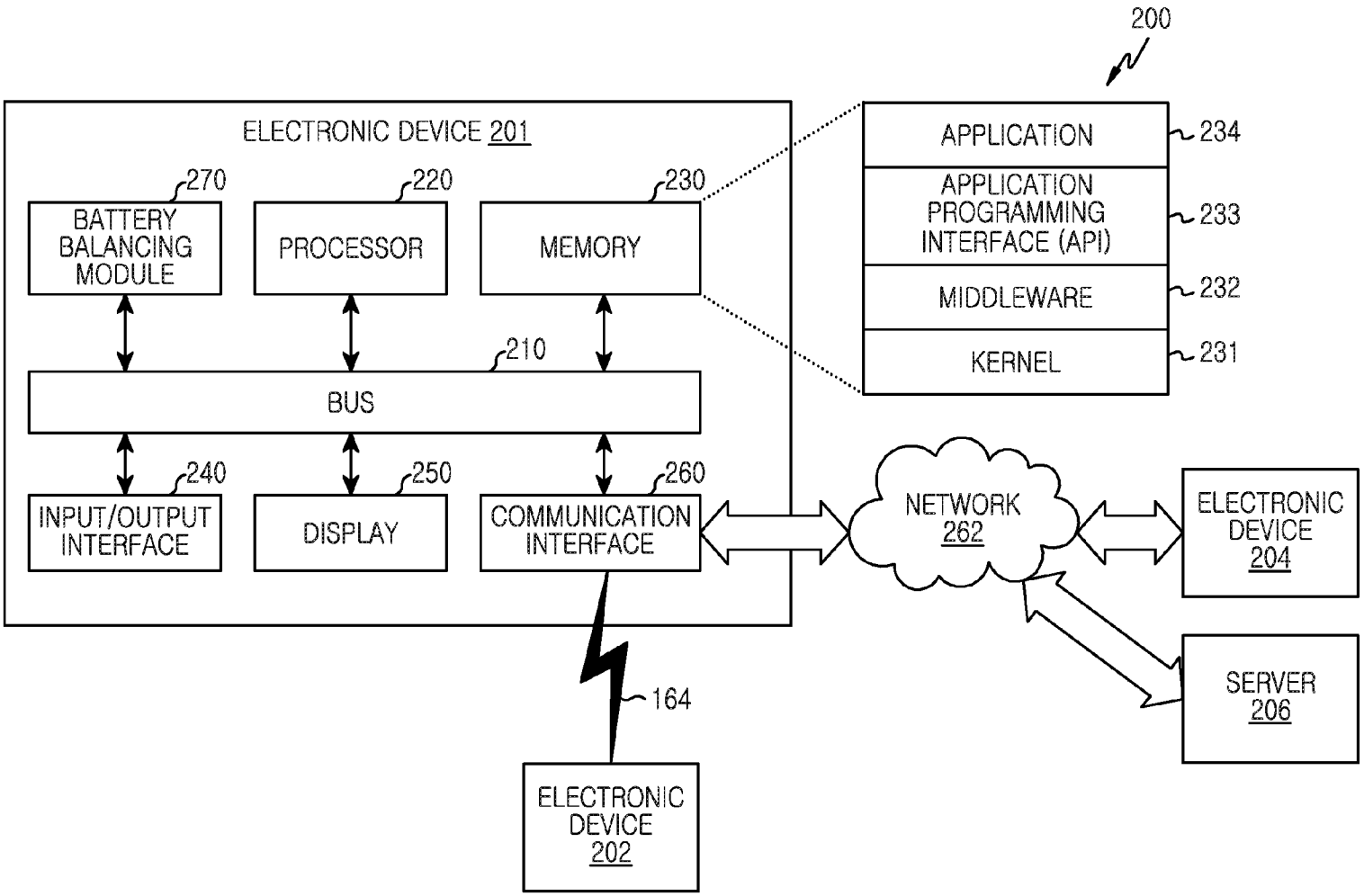
FIG. 2 is a block diagram of an electronic device for battery balancing of a hearing aid according to various embodiments of the present disclosure.

FIG. 2 is a block diagram of an electronic device for battery balancing of a hearing aid according to various embodiments of the present disclosure.

A network environment 200 including an electronic device 201 is illustrated in FIG. 2 according to various embodiments of the present disclosure. Referring to FIG. 2, the electronic device 201 may include a bus 210, a processor 220, a memory 230, an input/output interface 240, a display 250, a communication interface 260, and a battery balancing module 270.

The bus 210 may be a circuit for connecting the aforementioned constitutional elements to each other and for delivering a communication signal (e.g., a control message) between the aforementioned constitutional elements.

The processor 220 may receive an instruction from the aforementioned different constitutional elements (e.g., the memory 230, the input/output interface 240, the display 250, the communication interface 260, or the battery balancing module 270), for example, via the bus 210, and thus may interpret the received instruction and execute arithmetic or data processing according to the interpreted instruction.

The memory 230 may store an instruction or data received from the processor 220 or different constitutional elements (e.g., the input/output interface 240, the display 250, the communication interface 260, or the battery balancing module 270) or generated by the processor 220 or the different constitutional elements. The memory 230 may include programming modules such as a kernel 231, a middleware 232, an Application Programming Interface (API) 233, an application 234, and the like. Each of the aforementioned programming modules may consist of software, firmware, or hardware entities or may consist of at least two or more combinations thereof.

The kernel 231 may control or manage the remaining other programming modules, for example, system resources (e.g., the bus 210, the processor 220, the memory 230, etc.) used to execute an operation or function implemented in the middleware 232, the API 233, or the application 234. In addition, the kernel 231 may provide a controllable or manageable interface by accessing individual constitutional elements of the electronic device 201 in the middleware 232, the API 233, or the application 234.

The middleware 232 may perform a mediation role so that the API 233 or the application 234 communicates with the kernel 231 to exchange data. In addition, regarding task requests received from the application 234, for example, the middleware 232 may perform a control (e.g., scheduling or load balancing) for the task requests by using a method of assigning a priority capable of using a system resource (e.g., the bus 210, the processor 220, the memory 230, etc.) of the electronic device 201 to at least one of the applications 234.

The API 233 may include at least one interface or function (e.g., instruction) for file control, window control, video processing, character control, and the like, as an interface capable of controlling a function provided by the application 234 in the kernel 231 or the middleware 232.

According to various embodiments of the present disclosure, the application 234 may include a Short Message Service (SMS)/Multimedia Messaging Service (MMS) application, an e-mail application, a calendar application, an alarm application, a health care application (e.g., an application for measuring a physical activity level, a blood sugar, etc.) or an environment information application (e.g., atmospheric pressure, humidity, or temperature information). Additionally or alternatively, the application 234 may be an application related to an information exchange between the electronic device 201 and an external electronic device (e.g., an electronic device 202 or an electronic device 204). The application related to the information exchange may include, for example, a notification relay application for relaying specific information to the external electronic device or a device management application for managing the external electronic device.

For example, the notification relay application may include a function of relaying notification information generated in another application (e.g., an SMS/MMS application, an e-mail application, a health care application, an environment information application, etc.) of the electronic device 201 to the external electronic device (e.g., the electronic device 202 or the electronic device 204). Additionally or alternatively, the notification relay application may receive notification information, for example, from the external electronic device (e.g., the electronic device 202 or the electronic device 204) and may provide it to the user. The device management application may manage (e.g., install, delete, or update), for example, a function (e.g., turning on/turning off the external electronic device itself (or some components thereof) or adjusting a display illumination (or a resolution)) for at least one part of the external electronic device (e.g., the electronic device 202 or the electronic device 204) which communicates with the electronic device 201, an application which operates in the external electronic device, or a service (e.g., a call service or a message service) provided by the external electronic device.

According to various embodiments of the present disclosure, the application 234 may include an application specified according to attribute information (e.g., an electronic device type) of the external electronic device (e.g., the electronic device 202 or the electronic device 204). For example, if the external electronic device is an MP3 player, the application 234 may include an application related to a music play. Similarly, if the external electronic device is a mobile medical device, the application 234 may include an application related to a health care. According to one embodiment, the application 234 may include at least one of a specified application in the electronic device 201 or an application received from the external electronic device (e.g., a server 206, the electronic device 202, or the electronic device 204).

The input/output interface 240 may relay an instruction or data input from a user by using a sensor (e.g., an acceleration sensor, a gyro sensor) or an input device (e.g., a keyboard or a touch screen) to the processor 220, the memory 230, the communication interface 260, or the battery balancing module 270, for example, via the bus 210. For example, the input/output interface 240 may provide data regarding a user's touch input via the touch screen to the processor 220. In addition, the input/output interface 240 may output an instruction or data received from the processor 220, the memory 230, the communication interface 260, or the battery balancing module 270 to an output device (e.g., a speaker or a display), for example, via the bus 210. For example, the input/output interface 240 may output audio data provided by using the processor 220 to the user via the speaker.

The display 250 may display a variety of information (e.g., multimedia data or text data) to the user.

The communication interface 260 may connect a communication between the electronic device 201 and an external device (e.g., the electronic device 202, the electronic device 204, or the server 206). For example, the communication interface 260 may support a network communication 262 (e.g., Internet, Local Area Network (LAN), Wide Area Network (WAN), telecommunication network, cellular network, satellite network, Plain Old Telephone Service (POTS), etc.) and a short distance communication 164 (e.g., Wi-Fi, Bluetooth (BT), NFC, or wired communication (e.g., Universal Serial Bus (USB), High Definition Multimedia Interface (HDMI), Recommended Standard (RS)-232, POTS, etc.). According to one embodiment, a protocol for a communication between the electronic device 201 and the external device (e.g., a short distance communication protocol, a network communication protocol, or a wired communication protocol) may be supported in at least one of the API 233 and the middleware 232. Each of the electronic devices 202 and 204 may be a device which is the same (e.g., the same type) as the electronic device 201 or may be a different (e.g., a different type) device.

The battery balancing module 270 may process at least a part of information acquired from other constitutional elements (e.g., the processor 220, the memory 230, the input/output interface 240, the communication interface 260, etc.), and may provide it to the user in various manners. For example, in order to adjust battery balancing of the binaural hearing aid either by using the processor 220 or independently, the battery balancing module 270 may control at least a part of functions of the electronic device 201. Additional information regarding the battery balancing module 270 is provided with reference to FIG. 3 described below.

According to various embodiments of the present disclosure, the battery balancing module 270 of the electronic device (e.g., the electronic device 201) determines whether a connection of a first hearing aid through the communication interface 260 is maintained for more than a specific period, and if the connection with the first hearing aid is maintained for more than the specific period, reports to the processor 220 that the connection with a second hearing aid needs to be established and that the connection with the first hearing aid needs to be terminated. Herein, the termination of the connection with the first hearing aid may be performed before or after the connection is achieved to the second hearing aid.

Before determining that the connection with the first hearing aid is maintained for more than the specific period, the battery balancing module 270 may further perform an operation of determining whether a remaining battery capacity of the first hearing aid is greater than or equal to a threshold.

The battery balancing module 270 may determine whether the connection with the first hearing aid is maintained for more than a specific period when the remaining battery capacity of the first hearing aid is above the threshold, and may provide corresponding information to the processor 220 to establish the connection with the second hearing aid when the remaining battery capacity of the first hearing aid is below the threshold.

The battery balancing module 270 may determine whether the connection with the second hearing aid is maintained for more than the specific period, and if the connection with the second hearing aid is maintained for more than the specific period, may perform an operation of reconnecting with the first hearing aid. The battery balancing module 270 may further perform an operation of terminating the reconnection with the first hearing aid, and the termination of the reconnection with the first hearing aid may be performed before or after the connection with the second hearing aid is achieved.

The battery balancing module 270 may determine whether the connection with the second hearing aid is maintained for more than the specific period, and may further perform an operation of determining whether the remaining battery capacity of the second hearing aid is above the threshold, and if the remaining battery capacity of the second hearing aid is above the threshold, may perform an operation of determining whether the connection with the second hearing aid is maintained for more than the specific period, and if the remaining battery capacity of the second hearing aid is below the threshold, may perform an operation of reconnecting with the first hearing aid.

Figure 3:
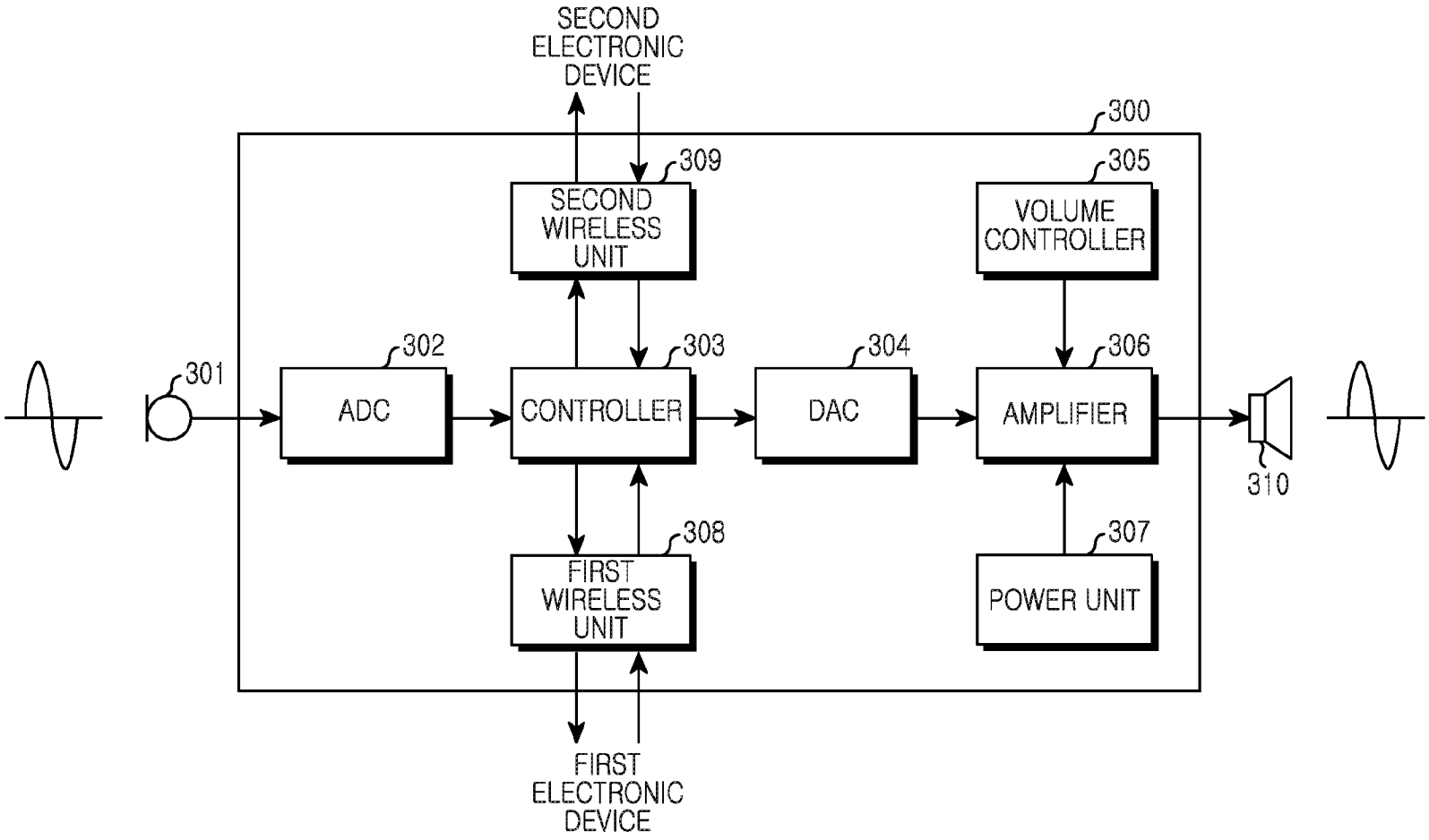
FIG. 3 is a block diagram of a hearing aid for maintaining battery balancing according to various embodiments of the present disclosure.

FIG. 3 is a block diagram of a hearing aid for maintaining battery balancing according to various embodiments of the present disclosure.

Referring to FIG. 3, a hearing aid 300 may include a microphone 301, an Analog Digital Converter (ADC) 302, a controller 303, a Digital Analog Converter (DAC) 304, a volume controller 305, an amplifier 306, a power unit 307, a first wireless unit 308, a second wireless unit 309, and a receiver 310.

The microphone 301 is located outside or may otherwise receive sound from outside the hearing aid attached to a user's ear, receives sound around the ear, and delivers an analog signal corresponding to the received sound to the ADC 302. The ADC 302 converts the analog signal delivered from the microphone 301 into a digital signal. With respect to the digital signal delivered from the ADC 302, the controller 303 performs digital signal processing such as noise removal, feedback control, non-linear amplification, and the like used in the hearing aid, and thereafter delivers the processed signal to the DAC 304. Further, the controller 303 may deliver user auditory characteristic information (e.g., audiogram) to a first electronic device via the first wireless unit 308, may deliver control information (e.g., an environment profile for configuring an amplification gain for each frequency according to a surrounding environment signal), control instructions, or the like, delivered from the first electronic device via the first wireless unit 308, and may use this to apply a processing result to a signal to be delivered to the DAC 304. Further, the controller 303 may perform processing by delivering audio streaming or a parameter for a binaural hearing aid to a second electronic device (e.g., a hearing aid of the other side) via the second wireless unit 309, or by receiving the audio streaming or the parameter for the binaural hearing aid from the second electronic device (e.g., the hearing aid of the other side).

According to various embodiments of the present disclosure, if the hearing aid 300 is a master device, the controller 303 may transmit a signal corresponding to an instruction for activating the first wireless unit of the hearing aid of the other side (e.g., a unit of performing a communication with the first electronic device) to the hearing aid of the other side, and may allow its first wireless unit 308 to transition to an inactive state.

Alternatively, if the hearing aid 300 is a slave device, the controller 303 may receive a signal corresponding to an instruction of activating its first wireless unit 308 from the hearing aid of the other side to activate the first wireless unit 308.

The volume controller 305 adjusts a gain value of the amplifier 306 by using information based on a user's manipulation. The amplifier 306 applies the gain value adjusted in the volume controller 305 with respect to an analog signal which is input from the DAC 304, and then amplifies a signal by using power of the power unit 307. The receiver 310 reproduces a signal, which is output from the amplifier 306, into an audible signal.

The controller 303 or the amplifier 306 may configure a gain controller which updates or temporality adjusts a non-linear amplification gain according to control information or instructions transmitted from the first electronic device.

Figure 4:
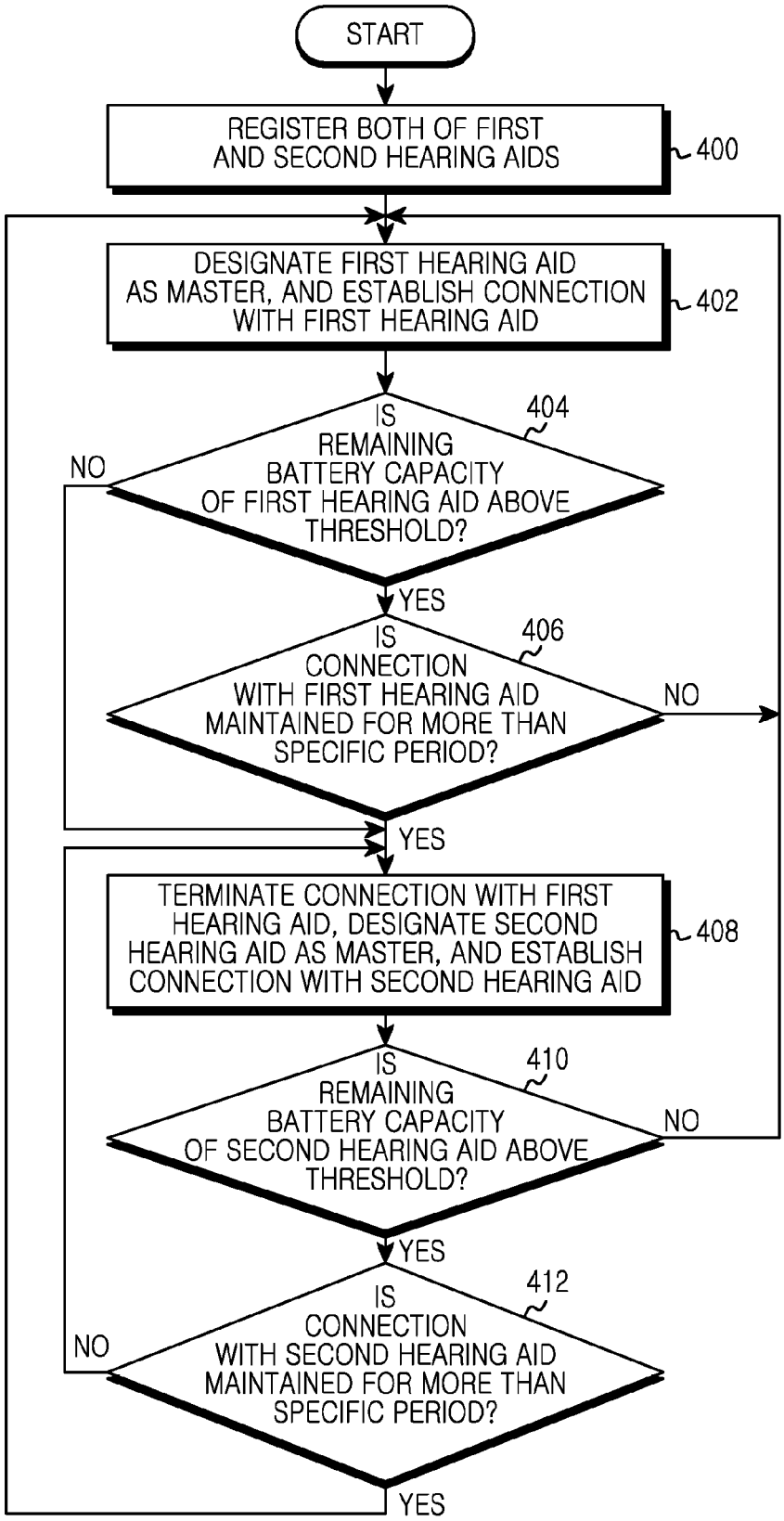
FIG. 4 is a flowchart of an operation for adjusting battery balancing of a hearing aid in an electronic device according to various embodiments of the present disclosure.

FIG. 4 is a flowchart of an operation for adjusting battery balancing of a hearing aid in an electronic device according to various embodiments of the present disclosure.

Referring to FIG. 4, in operation 400, the electronic device may register hearing aids of both sides (e.g., the hearing aids 100 and 110 of FIGS. 1A and 1B) by pairing both of them.

In operation 402, on the basis of a channel state or a signal strength, the electronic device may designate a first hearing aid between the hearing aids of both sides as a master device, and then may establish a connection with the first hearing aid. For example, between the hearing aid and the electronic device, any device having a superior channel may be selected as the master device.

In operation 404, the electronic device may determine whether a remaining battery capacity of the first hearing aid is above a threshold, and if it is above the threshold, may perform operation 406, and if it is below the threshold, may proceed to operation 408. The operation of determining whether the remaining battery capacity of the first hearing aid is above the threshold may be an operation of receiving information regarding the remaining battery capacity of the first hearing aid or measuring the remaining battery capacity of the first hearing aid.

In operation 406, the electronic device may determine whether a connection with the first hearing aid is maintained for more than a specific period through a first wireless communication, and if the connection with the first hearing aid is maintained for more than the specific period, may proceed to operation 408, and if the connection with the first hearing aid is not maintained for more than the specific period, may return to operation 402.

In operation 408, the electronic device may terminate the connection with the first hearing aid, and may designate a second hearing aid as the master device and establish a connection with the second hearing aid. In this case, the first hearing aid may deliver a signal for preparing a connection with the electronic device to the second hearing aid before being disconnected from the electronic device. In addition, the first wireless communication of the first hearing aid for establishing the connection with the electronic device may be deactivated, and the wireless communication of the second hearing aid may be activated.

In operation 410, the electronic device may determine whether the remaining battery capacity of the second hearing aid is above a threshold, and if it is above the threshold, may perform operation 412, and if it is below the threshold, may return to operation 402.

In operation 412, the electronic device may determine whether the connection with the second hearing aid is maintained for more than a specific period through a first wireless communication, and if the connection with the second hearing aid is maintained for more than the specific period, may return to operation 402, and if the connection with the second hearing aid is not maintained, may return to operation 408.

Figure 5:
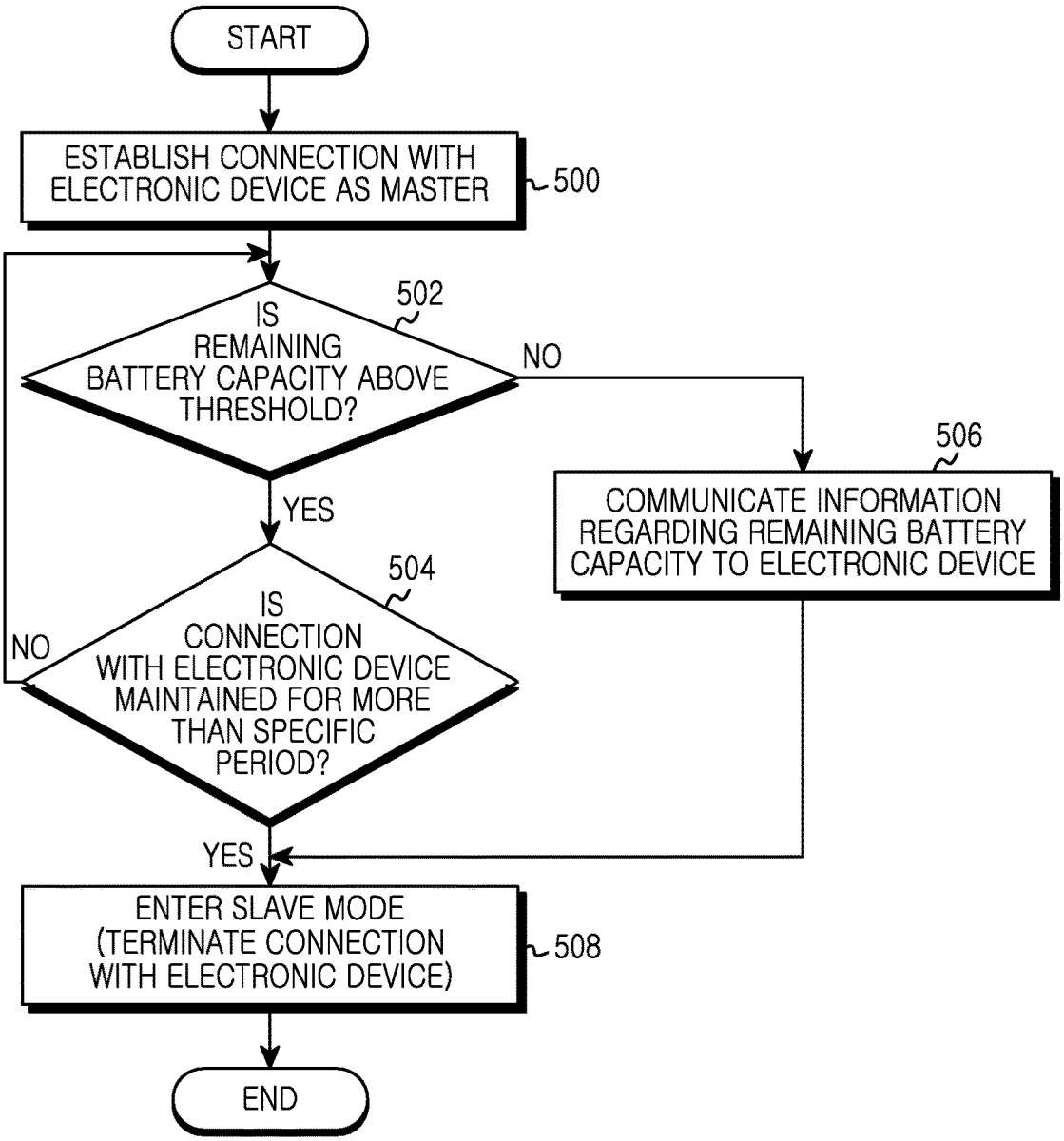
FIG. 5 is a flowchart of an operation for maintaining battery balancing of a hearing aid according to various embodiments of the present disclosure.

FIG. 5 is a flowchart of an operation for maintaining battery balancing of a hearing aid according to various embodiments of the present disclosure.

Referring to FIG. 5, in operation 500, as a master device, the hearing aid may establish a connection with an electronic device. For example, the hearing aid may be registered by performing a pairing procedure of a Bluetooth communication with the electronic device.

In operation 502, the hearing aid may determine whether its remaining battery capacity is above a threshold, and if the remaining battery capacity is above the threshold, may perform operation 504, and if the connection with the electronic device is maintained for more than a specific period, may proceed to operation 508 to enter a slave mode. For example, the hearing aid terminates the connection with the electronic device in operation 508. In this case, a first wireless unit for establishing the communication with the electronic device may be deactivated.

Further, the hearing aid may transmit to another hearing aid (e.g., a hearing aid on the other side) an instruction signal for instructing a preparation for the connection with the electronic device. For example, according to the instruction signal, the hearing aid of the other side may attempt to connect with the electronic device by activating the first wireless unit for establishing the communication with the electronic device.

On the other hand, if the remaining battery capacity is below the threshold, in operation 506, the hearing aid may communicate information regarding its remaining battery capacity to the electronic device.

According to various embodiments of the present disclosure, if the electronic device is capable of detecting the remaining battery capacity of the hearing aid, the hearing aid does not have to communicate information regarding the remaining battery capacity to the electronic device.

As described above, battery balancing of a binaural hearing aid is adjusted so that batteries can be discharged at similar times. Therefore, an inconvenience of replacing the batteries at different times can be avoided.

In addition, an unreasonable use of replacing a battery of the other side when a battery of one side is discharged is prevented, thereby being able to increase an efficiency of a battery usage.

Methods based on the various embodiments of the present disclosure disclosed in the claims and/or specification of the present disclosure can be implemented in hardware, software, or a combination of both.

When implemented in software, a non-transitory computer readable recording medium for storing one or more programs (i.e., software modules) can be provided. The one or more programs stored in the non-transitory computer readable recording medium are configured for execution performed by one or more processors in the electronic device. The one or more programs include instructions for allowing the electronic device to execute the methods based on the various embodiments disclosed in the claims and/or specification of the present disclosure.

The program (i.e., the software module or software) can be stored in a random access memory, a non-volatile memory including a flash memory, a Read Only Memory (ROM), an Electrically Erasable Programmable Read Only Memory (EEPROM), a magnetic disc storage device, a Compact Disc-ROM (CD-ROM), DVDs or other forms of optical storage devices, and a magnetic cassette. Alternatively, the program can be stored in a memory configured in combination of all or some of these storage media. In addition, the configured memory may be plural in number.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method in an electronic device for battery balancing of two hearing aids, the electronic device being other than the two hearing aids, the method comprising:

discovering, by the electronic device, the two hearing aids;

selecting, by the electronic device, a first hearing aid of the two hearing aids as a master device;

establishing, by the electronic device, a first wireless connection with the first hearing aid;

selecting, by the electronic device, alternatively and periodically a second hearing aid of the two hearing aids as the master device, if a duration time of the first wireless connection with the first hearing aid reaches a time period; and establishing, by the electronic device, a second wireless connection with the second hearing aid, if the second hearing aid is selected, wherein a non-selected hearing aid of the two hearing aids is not connected with the electronic device and enters a slave mode in response to the selected hearing aid being selected as the master device.

2. The method of claim 1, further comprising:

determining whether a remaining battery capacity of the selected second hearing aid is above a threshold after establishing the second wireless connection with the selected second hearing aid.

3. The method of claim 2, further comprising:

if the remaining battery capacity of the selected second hearing aid is above the threshold, maintaining the second wireless connection with the selected second hearing aid during the duration time, and if the remaining battery capacity of the selected second hearing aid is below the threshold:

releasing the second wireless connection with the selected second hearing aid, selecting the first hearing aid as the master device, and establishing a third wireless connection with the selected first hearing aid.

4. The method of claim 1, further comprising:

upon the two hearing aids being discovered, obtaining a signal strength of each hearing aid, wherein the selecting of the first hearing aid comprises selecting a hearing aid of the two hearing aids with a larger signal strength.

5. The method of claim 1, further comprising:

upon the two hearing aids being discovered, obtaining a channel state of each hearing aid, wherein the selecting of the first hearing aid comprises selecting a hearing aid of the two hearing aids with a superior channel state.

6. The method of claim 1, wherein the electronic device includes a smartphone.

7. An electronic device for battery balancing of two hearing aids, the electronic device being other than the two hearing aids and comprising:

a communication interface; and a battery balancing module configured to:

discover the two hearing aids via the communication interface, select a first hearing aid of the two hearing aids as a master device, establish a first wireless connection with the first hearing aid, select alternatively and periodically a second hearing aid of the two hearing aids as the master device, if a duration time of the first wireless connection with the first hearing aid reaches a time period, and establish a second wireless connection with the second hearing aid, if the second hearing aid is selected, wherein a non-selected hearing aid of the two hearing aids is not connected with the electronic device and enters a slave mode in response to the selected hearing aid being selected as the master device.

8. The electronic device of claim 7, wherein the battery balancing module is further configured to:

determine whether a remaining battery capacity of the selected second hearing aid is above a threshold after establishing the second wireless connection with the selected second hearing aid.

9. The electronic device of claim 8, wherein the battery balancing module is further configured to:

if the remaining battery capacity of the selected second hearing aid is above the threshold, maintain the second wireless connection with the selected second hearing aid during the duration time, and if the remaining battery capacity of the selected second hearing aid is below the threshold:

release the second wireless connection with the selected second hearing aid, select the first hearing aid as the master device, and establish a third wireless connection with the selected first hearing aid.

10. The electronic device of claim 7, wherein the battery balancing module is further configured to:

upon the two hearing aids being discovered, obtain a signal strength of each hearing aid, and wherein the selecting of the first hearing aid comprises selecting a hearing aid of the two hearing aids with a larger signal strength.

11. The electronic device of claim 7, wherein the battery balancing module is further configured to:

upon the two hearing aids being discovered, obtain a channel state of each hearing aid, and wherein the selecting of the first hearing aid comprises selecting a hearing aid of the two hearing aids with a superior channel state.

12. The electronic device of claim 7, wherein the electronic device includes a smartphone.

* * * * *